US008041485B2

(12) United States Patent
Prasetiawan et al.

(10) Patent No.: US 8,041,485 B2
(45) Date of Patent: Oct. 18, 2011

(54) SYSTEM AND METHOD FOR OPERATING A MACHINE

(75) Inventors: Eko A. Prasetiawan, Holly Springs, NC (US); Satyaki Guha, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 962 days.

(21) Appl. No.: 11/967,462

(22) Filed: Dec. 31, 2007

(65) Prior Publication Data

US 2009/0012679 A1 Jan. 8, 2009

Related U.S. Application Data

(60) Provisional application No. 60/883,023, filed on Dec. 31, 2006.

(51) Int. Cl.
*B60K 20/00* (2006.01)
*E02F 9/24* (2006.01)
*F16H 59/50* (2006.01)

(52) U.S. Cl. ..... 701/50; 701/62; 180/330

(58) Field of Classification Search ..... None
See application file for complete search history.

(56) References Cited

U.S. PATENT DOCUMENTS

| | | | | |
|---|---|---|---|---|
| 4,369,856 | A | 1/1983 | Nudd | |
| 4,373,850 | A | 2/1983 | Durham | |
| 4,774,921 | A | 10/1988 | Sakaguchi et al. | |
| 4,779,591 | A | 10/1988 | Tordenmalm | |
| 4,838,755 | A | 6/1989 | Johnson et al. | |
| 4,934,462 | A | 6/1990 | Tatara et al. | |
| 4,989,567 | A | 2/1991 | Fujioka | |
| 5,025,770 | A | 6/1991 | Richardson | |
| 5,088,020 | A | 2/1992 | Nishida et al. | |
| 5,092,408 | A | 3/1992 | Tatara et al. | |
| 5,377,777 | A | 1/1995 | Moore et al. | |
| 5,424,623 | A | 6/1995 | Allen et al. | |
| 5,425,431 | A | 6/1995 | Brandt et al. | |
| 5,471,908 | A | 12/1995 | Lech | |
| 5,479,908 | A | 1/1996 | Grinberg et al. | |
| 5,533,590 | A | 7/1996 | Steffen et al. | |
| 5,934,403 | A * | 8/1999 | Moore et al. | 180/336 |
| 5,995,893 | A | 11/1999 | Lee et al. | |
| 6,061,617 | A | 5/2000 | Berger et al. | |
| 6,131,062 | A | 10/2000 | Nielsen | |
| 6,140,787 | A | 10/2000 | Lokhorst et al. | |

(Continued)

FOREIGN PATENT DOCUMENTS

WO WO 2005/088169 A1 * 9/2005

*Primary Examiner* — Michael J. Zanelli
(74) *Attorney, Agent, or Firm* — William A. Beckman; Liell & McNeil

(57) ABSTRACT

A machine is provided. The machine includes a body, an engine, a transmission, a seat assembly, an electronic control module, a first transmission controller, and a second transmission controller. The engine is mounted within the body and powers the machine. The transmission is coupled to the engine. The seat assembly is rotatably mounted to the body and moveable between a first position and a second position. The electronic control module is in electrical communication with the engine and the seat assembly. The first transmission controller is in electrical communication with the electronic control module and operable to control the transmission with a first transmission command. The second transmission controller is in electrical communication with the electronic control module and operable to control the transmission a second transmission command when the seat assembly is in the first position and the first transmission command is neutral.

6 Claims, 4 Drawing Sheets

U.S. PATENT DOCUMENTS 6,220,567 B1 4/2001 Buelow
6,226,902 B1 5/2001 Heyne
6,643,577 B1 11/2003 Padgett et al.
6,694,240 B1 2/2004 Swick et al.
7,784,581 B1 * 8/2010 Klas et al. ..... 180/329
2007/0289803 A1 * 12/2007 Yoshikawa et al. ..... 180/336

* cited by examiner

| Remote Transmission Controller | First Controller (Column Shifter) | Seat Position Status | ECM Transmission Command |
|---|---|---|---|
| Forward | Forward | Front | Invalid, Neutral |
| Forward | Forward | Not Front | Invalid, Neutral |
| Forward | Neutral | Front | Forward |
| Forward | Neutral | Not Front | Invalid, Neutral |
| Forward | Reverse | Front | Invalid, Neutral |
| Forward | Reverse | Not Front | Invalid, Neutral |
| Neutral | Forward | Front | Forward |
| Neutral | Forward | Not Front | Invalid, Neutral |
| Neutral | Neutral | Front | Neutral |
| Neutral | Neutral | Not Front | Neutral |
| Neutral | Reverse | Front | Reverse |
| Neutral | Reverse | Not Front | Invalid, Neutral |
| Reverse | Forward | Front | Invalid, Neutral |
| Reverse | Forward | Not Front | Invailid, Neutral |
| Reverse | Neutral | Front | Reverse |
| Reverse | Neutral | Not Front | Invalid, Neutral |
| Reverse | Reverse | Front | Invalid, Neutral |
| Reverse | Reverse | Not Front | Invalid, Neutral |

FIG. 4

SYSTEM AND METHOD FOR OPERATING A MACHINE

CLAIM FOR PRIORITY

The present application claims priority from U.S. Provisional Application Ser. No. 60/883,023, filed Dec. 31, 2006, which is fully incorporated herein.

TECHNICAL FIELD

The present disclosure relates generally to a system and method for operating a machine, and more particularly, to a system and method for selecting an operator input device for a backhoe loader or another machine with a reorientable seat assembly.

BACKGROUND

Machines, such as skid steer loaders, multi terrain loaders, backhoe loaders, agricultural tractors, track-type tractors, articulated trucks, wheel loaders, and other types of construction, mining, or agricultural machinery are used for a variety of tasks requiring operator control. Typically, an operator controls these machines through an interface. For machines having a fixed operator orientation, only a single set of input devices are needed for various machine controls, such as for the throttle control or a transmission control. As a result, the controls for such operator interfaces may be optimized for available engine power, machine speed, sensitivity, and fuel economy.

However, in a machine having a reorientable operator interface controlling different operations, such as a backhoe loader, an operator may require more input devices, such as one operable in a forward direction and another operable in a reverse direction. Determining which input device to use and optimizing the controls may prove problematic.

The present disclosure is directed to overcome one or more of the problems as set forth above.

SUMMARY

In one aspect of the present disclosure, a machine is provided. The machine includes a body, an engine, a transmission, a seat assembly, an electronic control module, a first transmission controller, and a second transmission controller. The engine is mounted within the body and powers the machine. The transmission is coupled to the engine. The seat assembly is rotatably mounted to the body and moveable between a first position and a second position. The electronic control module is in electrical communication with the engine and the seat assembly. The first transmission controller is in electrical communication with the electronic control module and operable to control the transmission with a first transmission command. The second transmission controller is in electrical communication with the electronic control module and operable to control the transmission with a second transmission command when the seat assembly is in the first position and the first transmission command is neutral.

In another aspect of the present disclosure, a control system for use in a machine is provided. The control system includes a seat assembly position sensor operable to detect the position of a seat assembly, an electronic control module, a first and second transmission controller, and a transmission control algorithm. The electronic control module is in electrical communication with the seat assembly position sensor and includes the transmission control algorithm to control a transmission. The first and second transmission controllers are in electrical communication with the electronic control module. The transmission control algorithm uses the first transmission controller to control the transmission when the seat assembly is in a first position, and the transmission control algorithm uses the second transmission controller to control the transmission when the seat assembly is in the first position and the first transmission controller is in a neutral position.

In a third aspect of the present disclosure, a method of operating a machine having a transmission and a first and second transmission controller is provided. The method includes the step of detecting the position of a rotatable seat assembly. The method also includes the step of controlling the transmission with the first transmission controller when the seat assembly is in a first position. The method also includes the step of controlling the transmission with the second transmission controller when the seat assembly is in the first position and the first transmission controller is in a neutral position.

BRIEF DESCRIPTION OF THE DRAWINGS

FIG. 4 is a table listing a plurality of electronic control module transmission commands given the status of first and second transmission controller and a seat position as inputs.

DETAILED DESCRIPTION

Figure 1:
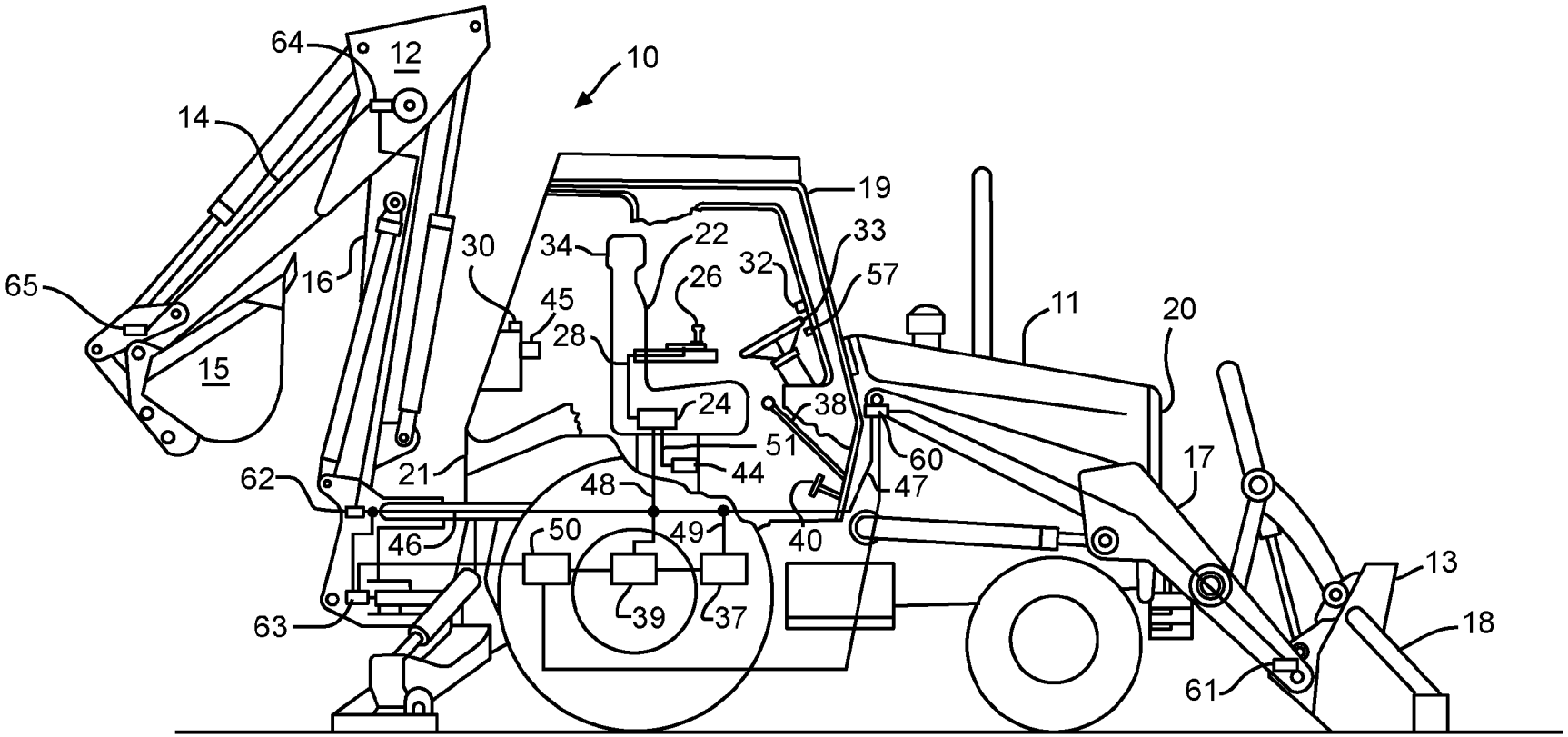
FIG. 1 is a side view of a backhoe loader including a seat assembly in a loader position.
Figure 2:
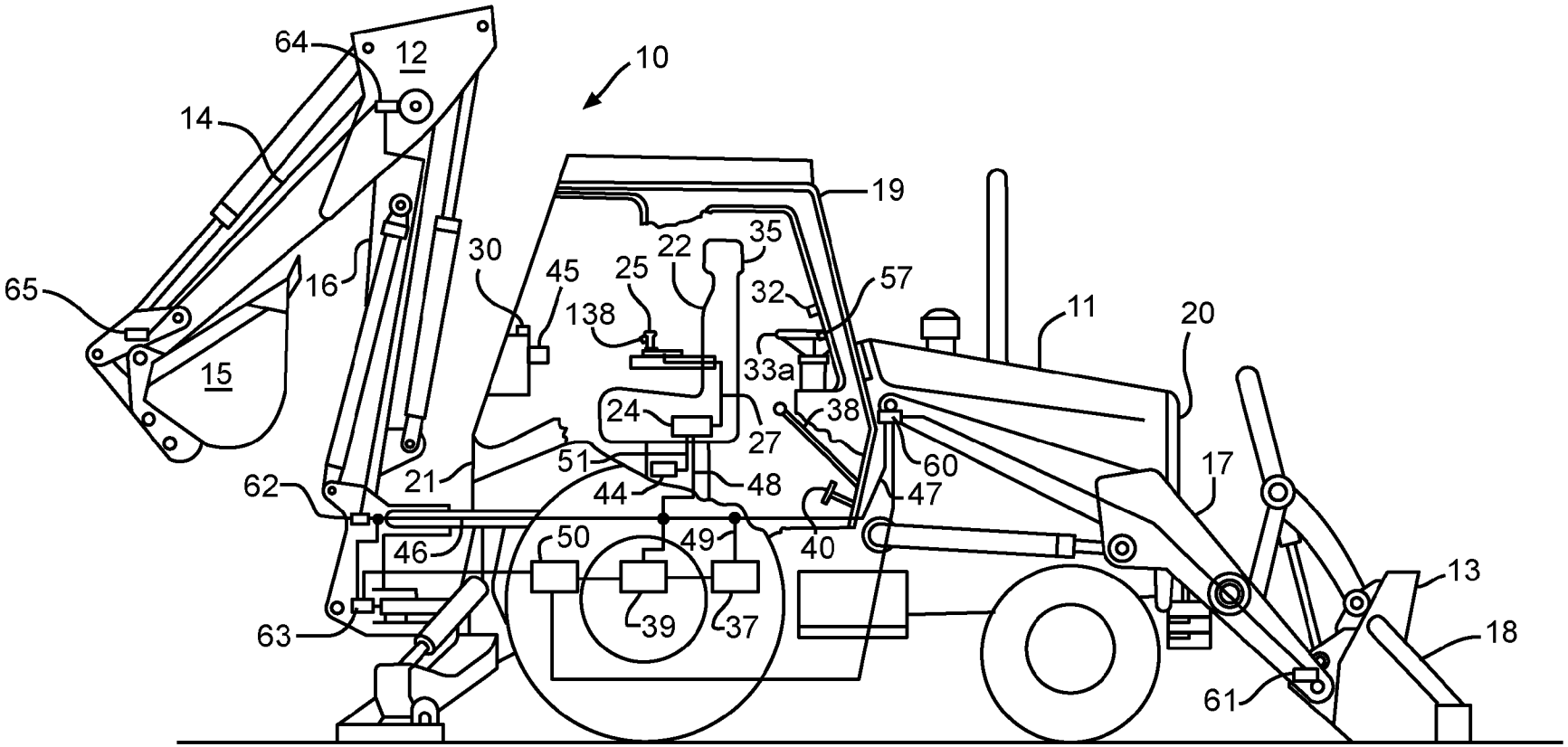
FIG. 2 is a side view of the backhoe loader including the seat assembly in a backhoe position.
Figure 3:
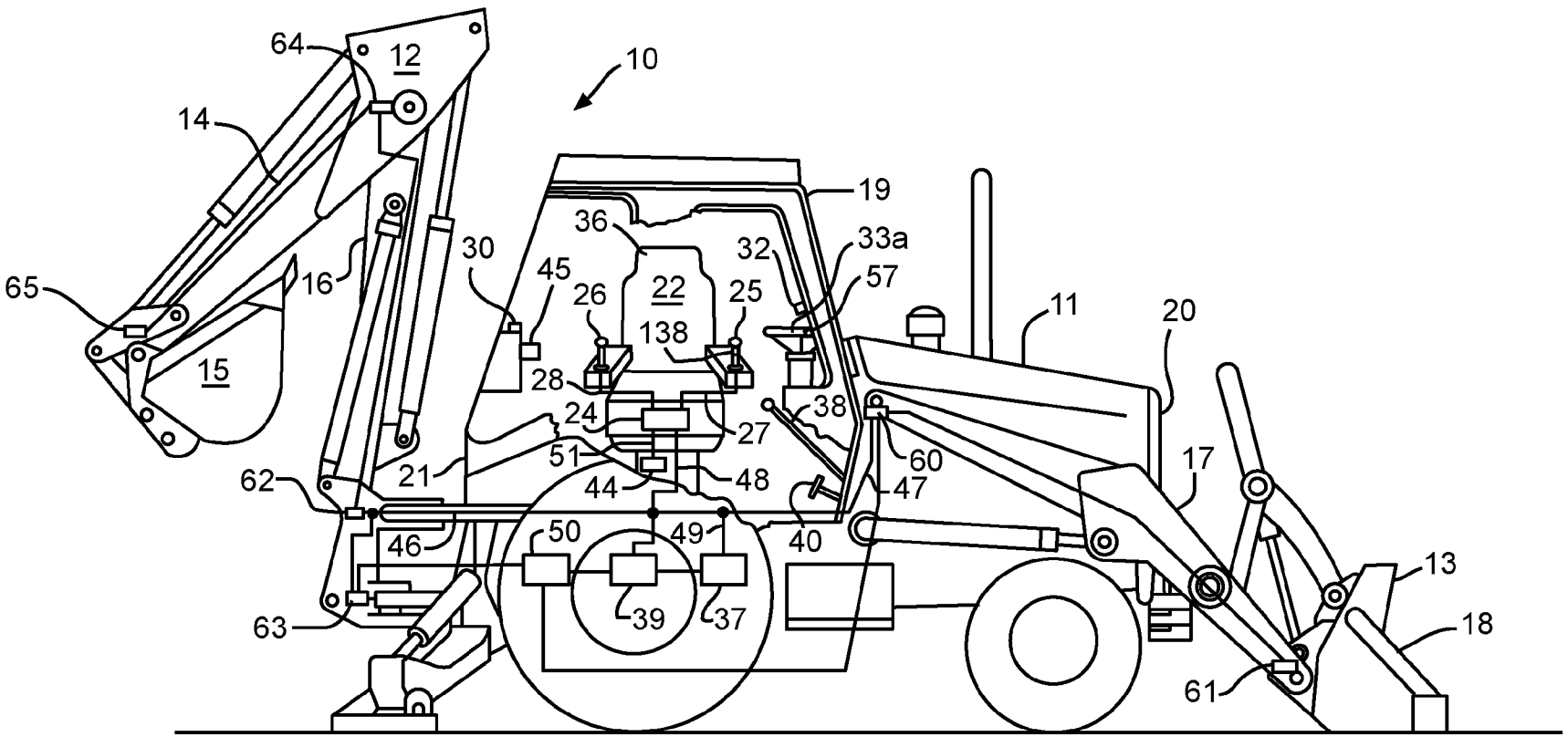
FIG. 3 is a side view of the backhoe loader including the seat assembly in a middle position.

Referring to FIGS. 1-3, there are shown side views of a machine 10, which in the illustrated example is backhoe loader 10. Those skilled in the art will appreciate that the present disclosure contemplates other machines such as pavers and/or graders, where different aspects of the machine are operated from different seat positions. Thus, although the machine 10 is illustrated as a backhoe loader 10, it should be appreciated that the present disclosure contemplates other types of machines. Those skilled in the art will appreciate that the term backhoe includes any machine with at least one implement used for stationary digging. For instance, the present disclosure could be applied to a backhoe dozer having a backhoe used for stationary digging attached to a rear side of the machine body and a dozer attached to a front side of the machine body. Further, the present disclosure may apply to a backhoe in which some other tool has been substituted in place of the backhoe bucket, such as a ram.

The backhoe loader 10 includes a machine body 11. Attached to a rear side 21 of the machine body 11 is a set of equipment, preferably a backhoe 12 generally used for stationary digging. Attached to a front side 20 of the machine body 11 is preferably a second set of equipment, shown as a loader 13 generally used for shoveling. The backhoe 12 includes a boom 16 that is moveably attached to the machine body 11, and can be moved upward and downward and swung left and right about a vertical axis. A stick 14 is moveably attached to the boom 16 and can be moved inward and outward. The backhoe 12 also includes a material engaging member, shown as a backhoe bucket 15 that is moveably attached to the stick 14. The backhoe bucket 15 can be curled in order to dig, and can be uncurled outward in order to dump material. The loader 13 includes a pair of arms 17 movably attached to the front side 20 of the machine body 11. The pair of arms 17 can be moved upward and downward in order to lift and lower a material engaging member, shown as a loader bucket 18. The loader bucket 18 is moveably attached to the pair of arms 17 and can be raised and lowered about a horizontal axis. There is at least one electronically controlled actuator attached to at least one hydraulic cylinder controlling the movement of each aspect of both the backhoe 12 and the loader 13, although mechanically or pressure controlled actuators may also be used. The illustrated backhoe loader 10 includes a loader arms actuator 60, a loader bucket actuator 61, a boom vertical movement actuator 62, a boom swing actuator 63, a stick actuator 64, and a backhoe bucket actuator 65.

An engine 39, which is attached to the machine body 11, is coupled to a transmission 37 in order to provide power for translational movement of the backhoe loader 10, and is coupled to at least one hydraulic pump 50 in order to provide power for operation of the backhoe 12 and the loader 13. The engine 39 may be any power source such as, for example, a diesel engine, a gasoline engine, a gaseous fuel driven engine, or any other engine known in the art. It is contemplated that the engine 39 may alternately include another source of power such as a fuel cell, a power storage device, an electric or hydraulic motor, and/or another source of power known in the art. It is also contemplated that the engine 39 may be operatively connected to the transmission 37 and the pump 50 by any suitable manner known in the art, such as, for example, gearing, a countershaft, and/or a belt. The engine 39 powers the hydraulic pump 50, which supplies pressurized hydraulic fluid to the hydraulic cylinders via the actuators 60, 61, 62, 63, 64, and 65. A throttle valve (not shown) controls the flow of fuel from the fuel pump to fuel injectors attached to the engine 39, and thereby controls the engine speed.

The backhoe loader 10 also includes a cab 19 in which a seat assembly 22 is rotatably mounted to the machine body 11. Although the seat assembly 22 may include translational movement, the seat assembly 22 rotates about a vertical axis between a forward facing position illustrated as a loader position 34 in FIG. 1, a rearward facing position illustrated as a backhoe position 35 in FIG. 2, and a middle facing position 36 in FIG. 3. The loader position 34 is preferably a latched position, and is separated by approximately 180 degrees from the backhoe position 35, also preferably a latched position. The middle facing position 36 is preferably an unlatched position between the loader position 34 and the backhoe position 35. When the seat assembly 22 is in the loader position 34, the loader 13 is preferably enabled. When the seat assembly 22 is in at least one of the backhoe position 35 and the middle facing position 36, the backhoe 12 is preferably enabled.

A seat position sensor 44 is positioned within the seat assembly 22. The seat assembly is in communication with an electronic control module 24 through a seat communication line 51.

The electronic control module or ECM 24 may include one or more microprocessors, a memory, a data storage device, a communications hub, and/or other components known in the art. It is contemplated that the ECM 24 may be further configured to receive additional inputs (not shown) indicative of various operating parameters of the machine 10 and or additional components, such as, for example, temperature sensors, positions sensors, and/or any other parameter known in the art. It is also contemplated that the ECM 24 may be preprogrammed with parameters and/or constants indicative of and/or relating to the machine 10. It is also contemplated that the ECM 24 may receive and deliver signals via one or more communication lines (not shown) as is conventional in the art. It is further contemplated that the received and delivered signals may be any known signal format, such as, for example, a current or a voltage level. Although it should be appreciated that the electronic control module 24 could be located within the machine body 11 or at any position within the seat assembly 22, the electronic control module 24 is illustrated as embedded in a seat of the seat assembly 22.

In addition, while implement controllers could be attached to the machine body 11, a first joystick 25 and a second joystick 26 are preferably attached to a right and left side of the seat assembly 22. Although the joysticks 25 and 26 could be mechanically operably coupled to the loader 13 and the backhoe 12, the first joystick 25 and the second joystick 26 are preferably in communication with the electronic control module 24 via a first communication line 27 and a second communication line 28, respectively. An engine speed reduction controller (not shown) may be mounted as a button attached to the second joystick 26, and is moveable between an on position and an off position, and is in communication with the ECM 24 via the second communication line 28. The ECM 24 is preferably in communication with the loader arms actuator 60 and the loader bucket actuator 61 via a loader communication line(s) 47, and is in communication with the boom vertical movement actuator 62, the boom swing actuator 63, the stick actuator 64, and the backhoe bucket actuator 65 via a backhoe communication line(s) 46. The ECM 24 is in communication with the engine 39 and the transmission 37 via an engine communication line 48 and a transmission communication line 49, respectively. Although the present disclosure is illustrated as including only one electronic control module 24, it should be appreciated that there could be any number of electronic control modules, including but not limited to, five additional electronic control modules, one to control each of the engine, the transmission 37, the backhoe 12, the loader 13, and the throttle valve 53, and each being in communication with the ECM 24.

A steering wheel 33 is preferably attached to the machine body 11 such that when the seat assembly 22 is in the loader position 34, the operator can use the steering wheel 33. The steering wheel 33 can be stowed for operation of the backhoe loader 10 when the seat assembly 22 is in the backhoe position 35 or the middle facing position 36.

Although it should be appreciated that a first transmission controller 38 could be attached to rotate with the seat assembly 22, the first transmission controller 38 is illustrated as attached to the machine body 11 such that when the seat assembly 22 is in the loader position 34, the operator can manipulate the first transmission controller 38. A second transmission controller 138 may also be provided. The second transmission 138 controller may include a column-mounted shifter, a joystick rocker switch, or a gear selector and used to control the transmission status. As shown in FIGS. 2-3, the second transmission controller 138 is remotely mounted to the left joystick 25 as a joystick rocker switch, selectable between forward, reverse, and neutral transmission states. The transmission 37 may be a mechanical or electrical variable-speed drive, a gear-type transmission, a hydrostatic transmission, or any other transmission known in the art. The first transmission controller 38 and the second transmission controller 138 operatively shift the transmission 37 between forward, neutral, and reverse gears.

An engine speed reduction-disabling switch 30 is preferably attached to a console on the rear side 21 of the machine body 11, and is moveable between an activated position and a de-activated position.

Although it should be appreciated that there could be only one manual throttle controller, the present disclosure is illustrated as including two throttle controllers 40, 45. A first throttle controller, preferably a hand operated throttle controller 45, is preferably moveably attached to the console on the rear side 21 of the machine body 11. The operator can control the engine speed when the transmission 37 is not engaged by manipulating the hand-operated throttle controller 45. The hand operated throttle controller 45 may be a ten-position rotary switch that is moveable between various throttle settings, including but not limited to, an increased throttle setting backhoe operation and a predetermined low idle engine setting. A predetermined low idle speed throttle setting could be less than 1000 rpm. Although the predetermined low idle speed and the increased engine speed may vary depending on the size and type of the backhoe, those skilled in the art should appreciate that the predetermined low idle speed is an engine speed that provides the minimum power required to maintain idling of the backhoe loader 10, and the increased engine speed is an engine speed that provides sufficient power to operate the hydraulically-controlled backhoe 12.

A second throttle controller, preferably a foot pedal 40, is also attached to the machine body 11, although it should be appreciated that the foot pedal 40 could be attached to the seat assembly 22 at a point that the operator can reach when operating the loader 13. The foot pedal 40 allows the operator to control the machine speed when driving the backhoe loader 10 and, at least in part, when operating the loader 13. The throttle controllers 40, 45 and the transmission controller 38 are coupled to ECM 24 and the transmission 37, respectively. It should be appreciated that the throttle controllers 40, 45 and the transmission controller 38 could be mechanically operably coupled or electronically operably coupled via the electronic control module 24 to the to the fuel system and the transmission 37, respectively.

INDUSTRIAL APPLICABILITY

In operation, the transmission control strategy for a backhoe loader is illustrated in the table of FIG. 4. The strategy provides a directional transmission command from the ECM 24 based on the status of the first transmission controller 38, the second or remote transmission controller 138, and the status of the seat position sensor 44. If the status of the first transmission controller 38, the second transmission controller 138, and the seat position sensor 44 conflict, the strategy overrides the operator input and commands the transmission to neutral. For example, if non-neutral (i.e., forward and reverse) commands are sent by both the first transmission controller 38 and the second transmission controller 138, the ECM 24 sends an invalid signal to the operator and overrides the operator input by sending a neutral command to the transmission 37. The invalid signal to the operator may be an audible alarm, a warning light on a display, or any other technique known in the art.

The ECM 24 will also override commands from the second transmission controller 138 when the seat assembly 22 is in the middle facing position 36 or the rearward facing position 35 and command the transmission 37 to neutral. This prevents the operator from engaging the transmission 37 when facing the backhoe and lacking access to the brake pedal (not shown). When the seat position sensor 44 indicates that the seat assembly 22 is not in the forward facing position 34, the only valid operator input transmitted to the transmission 37 would be a neutral command from both the first transmission controller 38 and the second transmission controller 138.

When the seat assembly 22 is in the forward facing position 34, either the first transmission controller 38 or the second transmission controller 138 can command the ECM 24 to send a forward signal to the transmission 37, provided the other of the first transmission controller 38 and the second transmission controller 138 is in the neutral position.

This strategy ergonomically allows the operator to use a remote transmission controller 138 during loader operations such as truck loading, while preventing activation when the seat assembly 22 is not facing forward, such as during backhoe operations. On previous machines, an operator would have to move his hands off of a joystick and use a column shifter anytime he wanted to change direction.

Other aspects, objects and advantages of this disclosure can be obtained from a study of the drawings, the disclosure, and the appended claims.

What is claimed is:

1. A machine comprising:

a body;

an engine mounted within the body and powering the machine;

a transmission coupled to the engine;

a seat assembly being rotatably mounted to the body and moveable between a first position and a second position, wherein the seat assembly includes a seat assembly position sensor operable to detect the first position and the second position;

an electronic control module in electrical communication with the engine, the transmission, and the seat assembly position sensor;

a first transmission controller in electrical communication with the electronic control module and operable to control the transmission with a first transmission command; and a second transmission controller in electrical communication with the electronic control module and operable to control the transmission with a second transmission command;

wherein the first transmission control operable to control the transmission using a forward command and a reverse command only when the seat assembly is in the first position and the second transmission command is neutral;

wherein the second transmission controller is operable to control the transmission using forward command and the reverse command only when the seat assembly is in the first position and the first transmission command is neutral.

2. The machine of claim 1, wherein the machine is a backhoe loader.

3. A control system for use in a machine, comprising:

a seat assembly position sensor operable to detect a position of a seat assembly;

an electronic control module in electrical communication with the seat assembly position sensor and including a transmission control algorithm to control a transmission;

a first transmission controller in electrical communication with the electronic control module;

a second transmission controller in electrical communication with the electronic control module; and the transmission control algorithm using the first transmission controller to control the transmission using a forward command and a reverse command only when the seat assembly is in a first position and the second transmission controller is in a neutral position, and the transmission control algorithm using the second transmission controller to control the transmission using the forward command and the reverse command only when the seat assembly is in the first position and the first transmission controller is in the neutral position.

4. The control system of claim 3, wherein the machine is a backhoe loader.

5. A method of operating a machine having a transmission, a first transmission controller, and a second transmission controller, including the steps of:

detecting a position of a rotatable seat assembly;

controlling the transmission with the first transmission controller using a forward command and a reverse command only when the rotatable seat assembly is in a first position and the second transmission command is in a neutral position; and controlling the transmission with the second transmission controller using the forward command and the reverse command only when the rotatable seat assembly is in the first position and the first transmission controller is in the neutral position.

6. The method of claim 5, wherein the machine is a backhoe loader.

* * * * *